US005526667A

United States Patent [19]

Baldi et al.

[11] Patent Number: 5,526,667

[45] Date of Patent: Jun. 18, 1996

[54] METHOD TO OBTAIN IN THE HOT STATE SINGLE ROUND BARS FROM HOT SINGLE MULTIPLE ELEMENTS, AND RELATIVE DEVICE

[75] Inventors: Ezio Baldi, Piombino; Claudio Piccotti, Gorizia, both of Italy

[73] Assignee: Danieli & C. Officine Meccaniche SpA, Buttrio, Italy

[21] Appl. No.: 395,153

[22] Filed: Feb. 27, 1995

Related U.S. Application Data

[63] Continuation of Ser. No. 79,869, Jun. 23, 1993, abandoned.

[30] Foreign Application Priority Data

Jun. 30, 1992 [IT] Italy ..... UD92A0119

[51] Int. Cl.[6] ..... B21B 15/00

[52] U.S. Cl. ..... 72/204; 72/250

[58] Field of Search ..... 72/203, 204, 250, 72/365.2, 366.2, 252.5

[56] References Cited

U.S. PATENT DOCUMENTS

| | | | |
|---|---|---|---|
| 281,184 | 7/1883 | Greer | 72/204 |
| 885,508 | 4/1908 | McKee | 72/204 |
| 1,977,285 | 10/1934 | McCleery | 72/204 |
| 4,275,491 | 6/1981 | Marinucci | 72/204 |
| 4,357,819 | 11/1982 | Elley | 72/204 |

FOREIGN PATENT DOCUMENTS

| | | | |
|---|---|---|---|
| 0199402 | 10/1986 | European Pat. Off. . | |
| 750785 | 8/1933 | France . | |
| 1021163 | 11/1952 | France . | |
| 13037 | 3/1881 | Germany . | |
| 2612714 | 3/1975 | Germany . | |
| 0058902 | 4/1982 | Japan . | |
| 0006202 | 1/1985 | Japan . | |
| 0127115 | 6/1987 | Japan . | |
| 0173001 | 7/1987 | Japan . | |
| 0173020 | 7/1987 | Japan . | |
| 0057907 | 3/1989 | Japan . | |
| 0100603 | 4/1992 | Japan | 72/204 |

OTHER PUBLICATIONS

Patent Abstracts of Japan vol. 12, No. 10 (M–658) (2857) Jan. 13, 1988; & JP A–62 173 001 (Nippon Steel) Jul. 29, 1987.

Patent Abstracts of Japan vol. 9, No. 235 (M–415) (1958) 21 Sep. 1985; & JP A–60 –092001 (Nippon Kokan) 23 May 1985—Abstract.

*Primary Examiner*—Lowell A. Larson
*Assistant Examiner*—Thomas C. Schoeffler
*Attorney, Agent, or Firm*—Antonelli, Terry, Stout & Kraus

[57] ABSTRACT

Method and device (10) to obtain in the hot state single finished round bars (12*a*–112*a*) from hot single multiple elements (11), wherein the device (10) cooperates with at least a penultimate finishing stand (25) and cooperates directly with rolls (26) of that finishing stand (25) and with generating profiles included in that stand (25) and comprises means to displace vertically and reciprocally the plane of positioning of each single bar (12*a*) forming the central part of the multiple element, and also comprises means to displace sideways on the plane of positioning at least the single outermost lateral bars (112*a*) of the multiple element (11), and further comprises upstream guiding system means (20) and mating wheel means (21–121) which define separation passes (13) and contain at least one lateral edge with a lateral wedge-shaped bevel (15).

13 Claims, 3 Drawing Sheets

METHOD TO OBTAIN IN THE HOT STATE SINGLE ROUND BARS FROM HOT SINGLE MULTIPLE ELEMENTS, AND RELATIVE DEVICE

This application is a Continuation of application Ser. No. 08/079,869, filed Jun. 23, 1993, now abandoned.

BACKGROUND OF THE INVENTION

This invention concerns a method and relative device to obtain in the hot state single round bars from hot single multiple elements.

The method arranges also that the single round bar obtained with this invention can be already finished in itself or may also form the starting base for producing other sections.

To be more exact, this invention concerns a method and relative device to obtain in the hot state single round bars from a single multiple element having a special multiple profile consisting of at least four single round bars and arriving on a rolling line by splitting the multiple element into its components and subjecting those components to at least one further hot rolling pass.

The single multiple element consists of a plurality of single bars placed side by side and connected together, the bars being united lengthwise along at least one of their edges.

Moreover, the method and relative device of this invention are used advantageously to obtain at least four round bars from one multiple element which contains and defines those bars.

The present applicants are aware of hot rolling methods which provide for the simultaneous hot rolling of one single multiple element containing a plurality of sections positioned side by side and connected together lengthwise so as then to split the single sections from each other still in the hot state.

These single multiple elements may be produced with a lengthwise connecting web between the single sections; in this case the connecting web has to be detached so as to separate the single sections forming the multiple element.

The state of the art covers also many devices to separate the single sections, whereby the separation is carried out by oxygen lance cutting or by means of shearing tools such as circular knives, cutters or the like.

While the first of these methods requires a subsequent step to trim the cutting zone, the second method does not ensure the required efficiency and requires a great number of tools which, besides taking up a great deal of space, need not a little maintenance.

JP-A-57-58902 discloses a method to separate the single sections forming a single multiple element, whereby the webs connecting the single sections are cooled with sprayed water before being sheared, the single sections being passed vertically into a rolling mill stand; but the method entails problems of cooling the sections and therefore cannot be applied to medium or small sections.

JP-A-60-6202 discloses a method for the hot rolling of a symmetrical multiple element consisting of two single asymmetrical sections connected by a web extending lengthwise. According to this method the splitting of the two single sections is carried out after the multiple element has been cooled. This method requires that the splitting should take place downstream of the cooling plate and not in the hot rolling line.

FR-A-750.785 too discloses a method to roll a multiple element, whereby the splitting of the single sections takes place after the multiple element has undergone a cooling step to prevent the single sections becoming curved; the splitting operation can be performed by striker tools, abrasives or by shearing. This method entails the same shortcomings and limitations as that disclosed in JP-A-60-6202.

JP-A-62-127115, JP-A-62-173020, EP-A-0199402 and JP-A-64-57907 disclose a device to split a multiple element consisting of two single sections joined together along one of their edges. The splitting devices disclosed in the above latter documents cannot be used on multiple elements consisting of more than two single sections.

JP-A-62-173001 discloses a splitting device for use on multiple elements consisting of four or even more single sections. With this device the single sections forming the multiple element have a substantially oval cross-section and are split by rotating each of the single sections about its own axis.

But this splitting device entails the problem of having to rotate these single oval sections so as to position them with their greater axis substantially vertical and to keep them in this position for the next rolling operation, by which they are shaped with a circular cross-section.

The method which employs this device requires also that the single sections, when split, should undergo at least two steps of rotation about their own axes before producing the desired single round bars; this situation entails extra costs as regards machinery and space occupied.

U.S. Pat. No. 1,977,285 discloses a method for the hot rolling of a multiple element, whereby the separation of the individual sections takes place by making the multiple element cooperate with two opposed rolls, on the surfaces of which are machined guides shaped according to the type of multiple element produced and alternately offset in relation to each other. This method can be applied to hot multiple elements leaving a rolling line and to cold multiple elements.

This teaching cannot be applied to sections rolled at high and medium-high speeds above 45–50 meters per second, since the guides have to carry out a first action of separating and steering the sections and perform very heavy work. This subjects the guides to a very great stress, which makes them unsuitable for use very quickly.

It is precisely owing to the intense work to be performed by the guides in pre-separating the single sections that the single sections are finished in the same rolling stand which completes the separation.

The state of the art includes also a method for separation in the hot state of single oval sections; this method consists in passing a multiple element into a rolling stand which subjects the single sections to rotation about their lengthwise axes and thereafter a vertical displacement as between the sections.

Next, this method requires successive passes to bring the single oval sections to the desired circular shape.

JP-A-60-92001 discloses a device to separate single bars, whereby the splitting into two separate assemblies is carried out by lateral displacement of one assembly of the single bars from the other assembly on their plane of movement. This device separates the multiple element into two assemblies at a time and therefore requires a great number of splitting devices where the multiple element consists of a great number of single bars. Moreover, the splitting elements consist of slitting rolls, which are supported on both sides, thus making the operations of maintenance and of freeing the device very complex and long.

In the device disclosed in FR-A-1,021,163 and DE-C-13,037 the single sections are separated by being moved vertically in relation to each other, this vertical movement being achieved with one or two pairs of rolls. Moreover, in the device of FR-A-1,021,163 the pairs of rolls are rotated at different speeds and are fitted within a supporting structure, thus requiring long and complex operations to free the rolls in the event of jamming and to perform normal maintenance. Moreover, the single bars, when split, are not distanced from each other and therefore cause great problems in the subsequent rolling operations.

The device disclosed in DE-A-2,612,714 includes a slitting wheel which cooperates with the web connecting two single sections forming a multiple element. The device can be used only with multiple elements consisting of two single sections, and also the slitting action performed by the slitting wheel does not enable work to be carried out at very high speeds. Moreover, the flash produced by slitting the web connecting the single sections may fall onto the cutting edges of the slitting wheel and thus may reduce the slitting power considerably and/or may fall onto the walls of the stationary separator means positioned downstream with the resulting formation of surface faults on the separated round sections.

The devices of the state of the art involve the above shortcomings and furthermore require heavy investment in the necessary rolling stands, in the space taken up by those stands and in installed and dissipated power with a resulting considerable pollution of the environment.

Moreover, if the multiple rolled element becomes jammed, the operations to free and restart the cycle with the devices of the state of the art are complicated and entail quite long times of stoppage of work.

SUMMARY OF THE INVENTION

The present applicants have studied, tested and obtained this invention so as to overcome the shortcomings of the state of the art and to achieve further advantages.

The main purpose of this invention is to provide a method and relative device which separate in the hot state single bars as defined in one single multiple element consisting of a plurality of the single bars.

The bars which the invention is intended to obtain by separation of the same in the hot state from a hot multiple element leaving the rolling line are round bars which are already substantially defined and finished.

The round bars thus obtained may be finished or may form a basis for the production of other sections.

The examples given hereinafter show the case of a multiple element consisting of four round bars, but the number of single bars forming the multiple element may be varied as desired.

The device of this invention is positioned advantageously upstream of the last but one rolling mill stand of a hot rolling train.

Up to the rolling mill stand immediately upstream of the device according to the invention the multiple element is processed by itself, whereas the single round bars are finished in the last two rolling mill stands.

According to the invention a box to split rolled stock is installed advantageously upstream of the penultimate rolling mill stand; in this box the multiple element consisting of at least four single round bars is split into the single round bars which form that element.

In the box to split the rolled stock the single round bars are separated by making the central bars pass alternately above and below the plane of sliding of the multiple element, whereas the outermost lateral round bars are traversed only sideways and substantially on the plane of sliding and are distanced from the single round bars forming the central part.

The single round bars, when separated in the box that splits the rolled stock according to the invention, are also progressively traversed sideways so as to obtain single emerging round bars suitably spaced apart.

The emerging single round bars are substantially aligned on the same horizontal plane of positioning, which corresponds to the rolling plane of the rolling mill stands placed downstream of the box to split the rolled stock according to the invention.

According to the invention the splitting is carried out by reciprocal traversing of the adjacent single bars on the horizontal plane and/or on the vertical plane, thus eliminating any stationary separating apparatus on which the flash might fall. Such flash falling on separating apparatus acts as a cutting element and may cause great surface faults such as would make the rolled round bars unacceptable.

Seeing that the single bars are split while they have a round cross-section, they are also free to rotate independently about their own axis, and this fact simplifies the successive processing steps considerably.

Next, the single round bars are rolled to have an oval cross-section and, after being rotated by 90° about their axis as in the state of the art, undergo a last rolling step which brings them to the required dimensions.

By means of the splitting device according to the invention the finished single round bar is produced with a minimum of two downstream rolling mill stands and one single step of rotation.

With the box to split the rolled stock according to the invention the rolling cycle is reduced since the single round bars, when separated, undergo only two rolling steps separated by a rotation step, whereas the state of the art requires three rolling steps and two steps of rotation of the single oval bars about their own lengthwise axes.

The box to split the rolled stock provides the advantage of requiring much smaller investments than the rolling and separating stands employed hitherto.

The box to split the rolled stock requires neither special installations nor technical and/or technological equipment, as instead does a rolling stand.

Moreover, the box to split the rolled stock has a compact structure and takes up much less space, with all the advantages provided by its inclusion in an existing rolling line without requiring additional rolling stands to be employed in the separation operations.

The box to split the rolled stock comprises at its upstream end a guide system which acts to position the multiple element correctly at the inlet of the box and to keep the element aligned within the box during the separation of the single bars.

The box to split the rolled stock comprises also two idler wheels positioned side by side with parallel axes and arranged respectively above and below the plane of sliding of the multiple element and cooperating therewith.

According to a variant the distance between centres of the idler wheels can be adjusted.

These idler wheels include in their central part two combined and mating profiles, each consisting of a series of sectors having alternate greater and smaller diameters.

These series, an upper series and lower series respectively, of mating profiles are arranged in such a way that a smaller diameter of the lower profile coincides with a greater diameter of the upper profile, and viceversa.

These profiles thus conceived determine a series of spaces arranged alternately and substantially above and below the plane of sliding of the multiple element; a single bar is caused to pass through each of the spaces, and the lengthwise splitting of the bars is thus achieved.

These wheels include lateral bevelled sectors able to induce in the outermost lateral bars forming the multiple element a traversing movement approximately on the plane of sliding, thus distancing the outermost lateral bars from the single bars forming the central part of the multiple element.

According to a variant the wheels are obtained by assembling a plurality of elementary wheels, each of which determines one or more greater and/or smaller diameters.

The box to split the rolled stock according to the invention includes advantageously a downstream guide which has the task of guiding and keeping separate the individual bars separated within the box.

The downstream guide includes advantageously a plurality of shaped guide channels of which the central channels are closer to each other than to the two lateral channels, which diverge advantageously.

Moreover, the central channels are so shaped that they distance the single bars sideways and bring them back to correspond with the outlet section substantially on the same plane as the single outermost lateral bars. In this way the successive rolling operations are made easier since all the single round bars are positioned suitably spaced apart on the same plane.

The box to split the rolled stock according to the invention may advantageously include means to cool the rolls of the rolling mill stand positioned immediately upstream and means to cool the lower and upper idler wheels; these cooling means will consist, for instance, of a plurality of sprayer nozzles.

The upper and lower idler wheels in the box to split the rolled stock according to the invention are fitted as cantilevers and can be withdrawn axially so as to facilitate their removal and to reduce intervention times, for instance in the event that the multiple element becomes jammed or for normal maintenance.

Furthermore, both the downstream guide and the upstream guide are removably fitted, by screws for instance, to the box that splits the rolled stock according to the invention.

The constructional simplicity of the box that splits the rolled stock according to the invention and of the upstream and downstream guides enables the times required for maintenance and adjustment to be greatly reduced and also enables equipment to be obtained which is stronger and simpler to construct.

BRIEF DESCRIPTION OF THE DRAWINGS

The attached figures are given as a non-restrictive example and show some preferred embodiments of the invention as follows.

Figure 1:
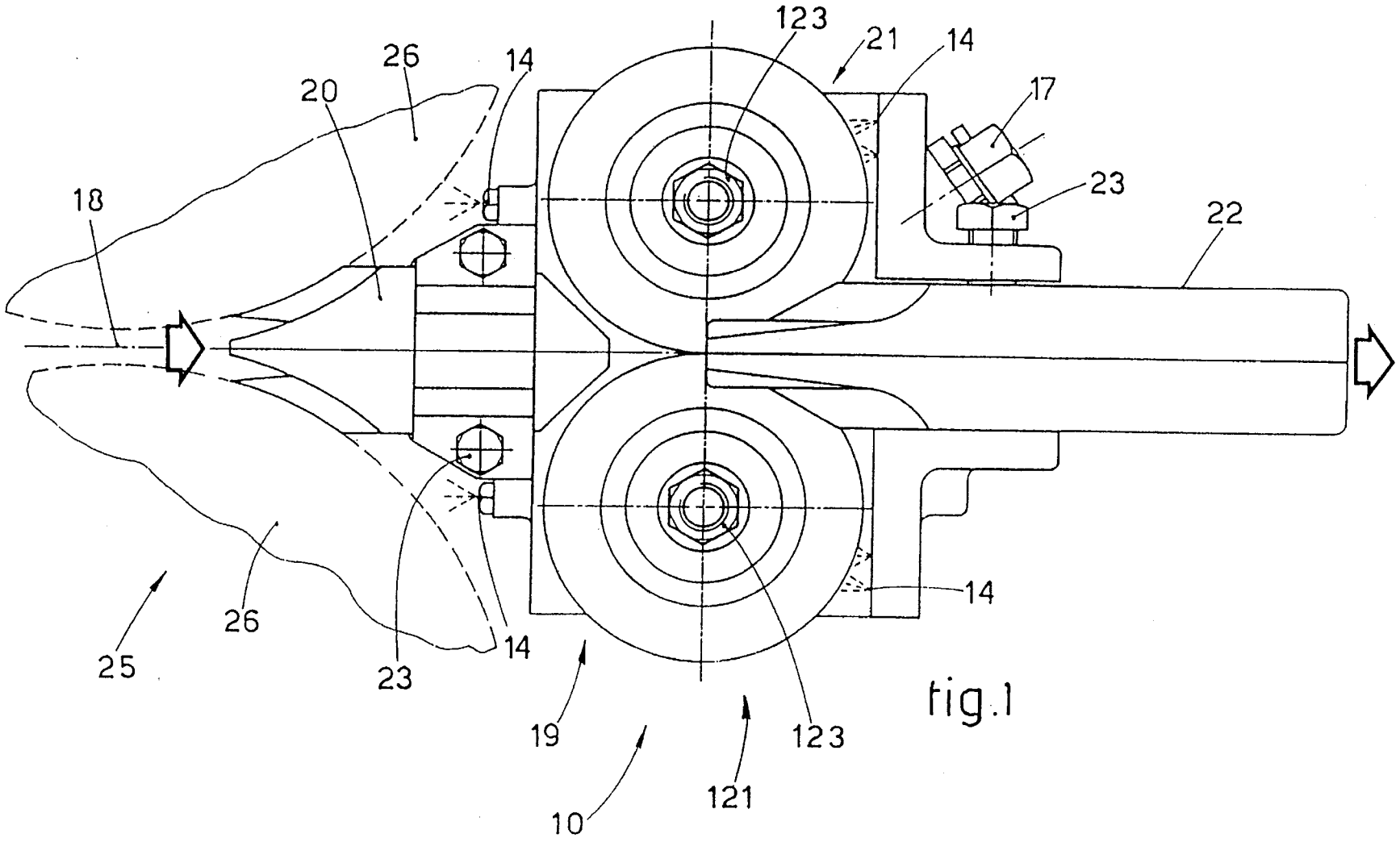
FIG. 1 is a side view of a box to split the rolled stock according to the invention.

FIG. **6*a*** is a diagram of the final steps of a possible cycle to roll a multiple element consisting of four round bars according to the state of the art;

FIG. **6*b*** is a diagram of the final steps of a possible cycle to roll a multiple element consisting of four round bars according to the invention.

DETAILED DESCRIPTION OF THE PREFERRED EMBODIMENTS

The reference number 10 in the attached figures indicates generally a device to separate a multiple element 11 lengthwise in the hot state, the element 11 including a plurality of single round bars **12*a*** in an intermediate state and joined together lengthwise.

In this case the multiple element 11 consists, for instance, of four single bars **12*a* in an intermediate state having a substantially circular cross-section, but the description that follows can be applied also to multiple elements 11 consisting of a desired variable number of single intermediate bars 12*a*** having a substantially circular cross-section.

According to the state of the art (see FIG. **6*a*) the multiple element 11 consisting of at least four single bars 12*b* having an oval cross-section and connected together along at least one of their lengthwise edges undergoes a separation step 27 by vertical displacement of the plane on which at least a part of the single oval bars 12*b*** lies.

Thereafter the single bars **12*b* with an oval cross-section undergo a first step of rotation 28*a* and then a rolling step 29, which brings them to a round cross-section, and thereafter a second rolling step 30**, which brings them back to an oval cross-section.

Next, the single bars **12*b* with an oval cross-section undergo a second rotation step 28*b* before undergoing a last rolling step 31, whence the desired single round bars 12** emerge.

In the method according to the invention the multiple element 11 consisting of at least four single bars **12*a* in an intermediate state having a circular cross-section and connected together along at least one of their lengthwise edges undergoes a separation step 27, from which the single round bars 12*a* in an intermediate state emerge suitably spaced apart and lying substantially on the plane 18** of their sliding.

Then the single intermediate round bars **12*a* undergo a rolling step 30, whence there emerge single bars 12*b* with an oval cross-section, which are rotated 28*b* and thereafter rolled 31 to form the single round bars 12** according to the state of the art.

According to the invention the separation device 10 consists of a box 19 to split the rolled stock, the box 19 being located at the outlet of the rolling stand 25 immediately upstream of the last finishing stand, which is not shown here.

The box 19 to split the rolled stock comprises an upstream guide system 20 cooperating directly with rolling rolls 26 of the rolling mill stand 25, with the outlet of which the box 19 is associated.

The box 19 to split the rolled stock includes also in a substantially central position two substantially coplanar wheels, an upper wheel 21 and lower wheel 121 respectively, positioned one above the other with their axes substantially parallel, and includes also a downstream guide 22.

These two upper 21 and lower 121 wheels are located respectively above and below the plane 18 on which the multiple element 11 slides.

The upstream guide system 20 comprises a plurality of substantially parallel guiding grooves 24 lying on the sliding plane 18 and having a shape and size coordinated with the passes in the rolling rolls 26 of the rolling mill stand 25 with which is associated the box 19 to split the rolled stock.

The guiding grooves 24 are suitable to engage and guide the multiple element 11 leaving the rolling mill stand 25 positioned immediately upstream of the device 10 according to the invention; the rolls 26 of the stand 25 are partly shown with lines of dashes in FIG. 1.

This upstream guide system 20 cooperates with the rolling mill stand 25 and has the task of guiding the multiple element 11 correctly when the latter 11 arrives to cooperate with the wheels 21–121.

The upper 21 and lower 121 wheels can rotate about their axes positioned on parallel planes, which are substantially equidistant from and parallel to the plane 18 on which the multiple element 11 slides.

The upper 21 and lower 121 wheels are fitted advantageously as cantilevers and in this example are clamped in position by relative lock nuts 123. When the lock nuts 123 are removed from the axles of the wheels 21–121, the upper and lower wheels 21–121 can be removed for maintenance and freeing operations.

Each of the upper 21 and lower 121 wheels can be embodied by assembling a plurality of elementary rings placed side by side, namely rings 21*a*–121*a* respectively of a greater diameter and rings 21*b*–121*b* respectively of a smaller diameter, or can be embodied with one single body.

In the upper 21 and lower 121 wheels each elementary ring having a small diameter 21*b*–121*b* and belonging to one wheel 21–121 is positioned opposite to a coordinated elementary ring having a greater diameter 21*a*–121*a* and belonging to the other wheel 121–21, and viceversa.

To be more exact, the pluralities of upper 21*a*–21*b* and lower 121*a*–121*b* elementary rings respectively arranged side by side to form the upper wheel 21 and lower wheel 121 respectively are reciprocally positioned transversely in such a way that each ring having a greater diameter 21*a* or 121*a* of the upper 21 or lower 121 wheel cooperates with a ring having a smaller diameter 121*b* or 21*b* of the lower 121 or upper 21 wheel.

The elementary rings 21*a*–121*b* and 21*b*–121*a* thus arranged define in the central part a series of passes 13 alternately positioned substantially above and below the plane 18 on which the multiple element 11 slides.

One single round bar 12*a* in the intermediate state is caused to run through each of these passes 13, and in this way the lengthwise separation of the single intermediate round bars 12*a* is achieved.

Outermost lateral elementary rings, both upper 12*c* and lower 121*c*, are bevelled and include peripherally a profile, a wedge-shaped profile 15, for instance. These outermost lateral elementary rings 21*c*–121*c* not only cooperate with the adjacent passes 13 but also displace sideways the single intermediate round bars 112*a* positioned at the outer ends of the multiple element 11 in such a way that these round bars 12*a* diverge from the rolling axis substantially on the plane 18 of sliding of these bars 112*a*. In this way the single round bars 12*a* in the intermediate state and especially the single outermost intermediate round bars 112*a* are kept separate on leaving the box 19 that splits the rolled stock according to the invention.

The box 19 to split the rolled stock comprises in its downstream portion a downstream guide 22, in which the single intermediate round bars 12*a*, after being split by the wheels 21–121, are kept separate and directed, for instance, to a finishing stand. To be more exact, the single round bars 12*a* in the intermediate state are caused to cooperate with guide channels 16 suitably machined in the downstream guide 22 and advantageously oriented in diverging directions so as to assist the handling of the bars 12*a* in the successive rolling operations.

Figure 4:
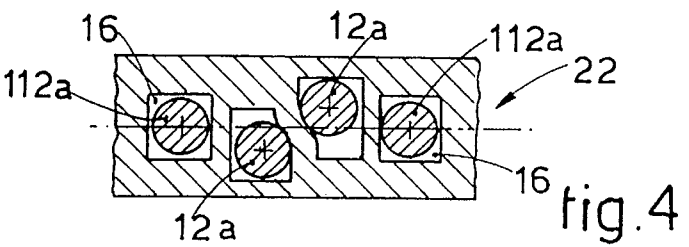
FIG. 4 shows a cross-section of the box to split the rolled stock of FIG. 2 along the line B—B in an enlarged scale.

FIG. 4 shows a cross-section of the intake part of the downstream guide 22, in which the central guide channels 16 for the passage of the single central intermediate round bars 12*a* have their walls suitably shaped to separate further in a transverse direction the single central intermediate round bars 12*a* which have just been split.

Figure 5:
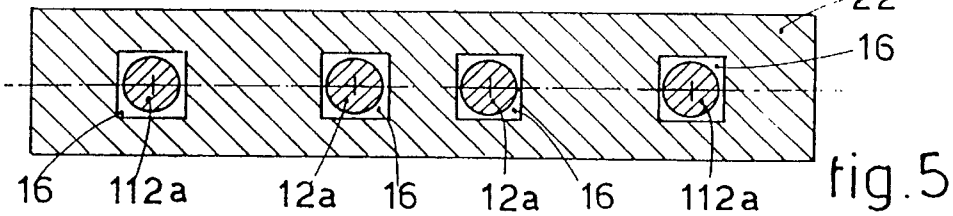
FIG. 5 shows in an enlarged scale a cross-section of the box to split the rolled stock of FIG. 2 along the line C—C.
Figure 3:
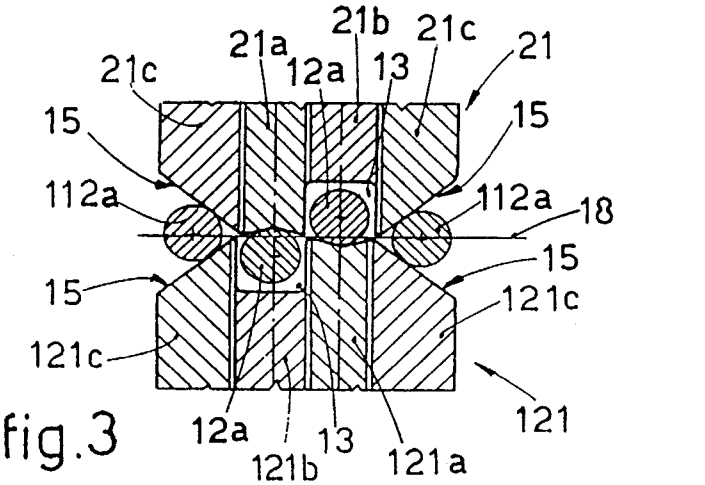
FIG. 3 shows a cross-section of the box to split the rolled stock along the line A—A of FIG. 2 in an enlarged scale.
Figure 6A:
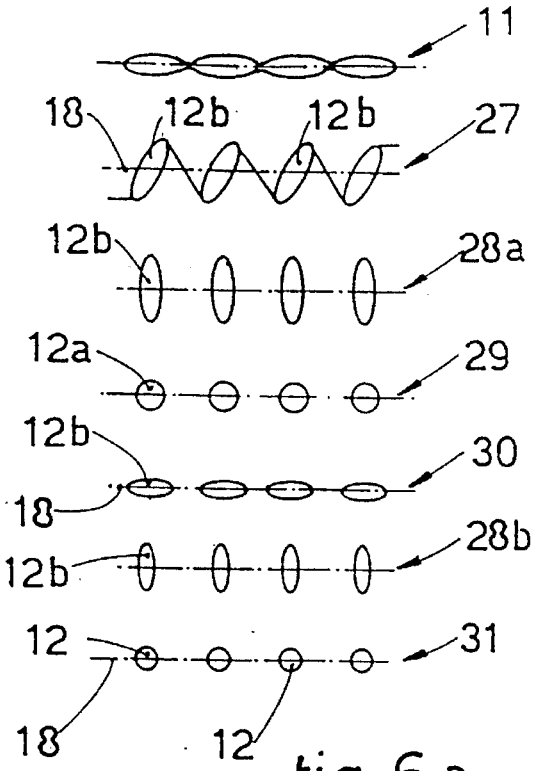
fig.6a PRIOR ART
Figure 6B:
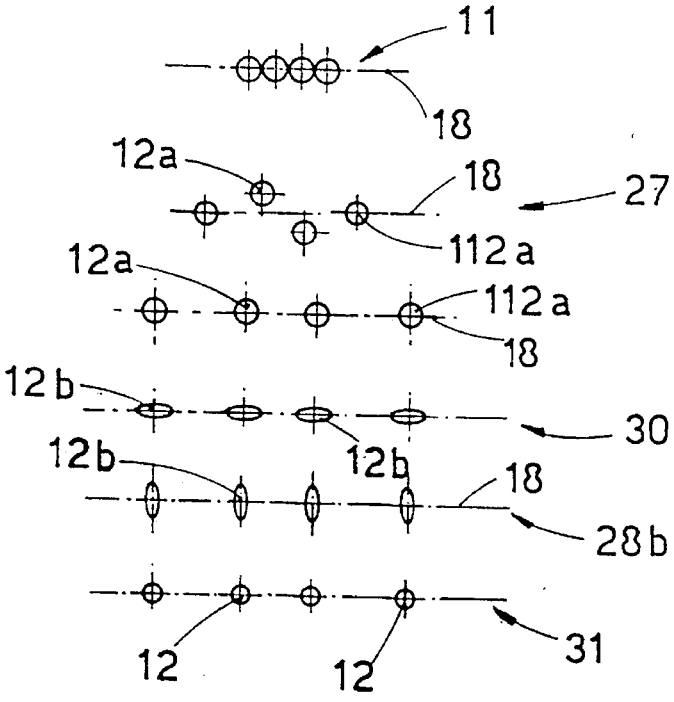

FIG. 5 shows the cross-section of the outlet of the downstream guide 22, in which the single intermediate round bars 12*a*, whether central 12*a* or outermost lateral 112*a* bars, lie with their axes on the sliding plane 18 and are suitably spaced apart to facilitate the subsequent rolling operations 30.

Figure 2:
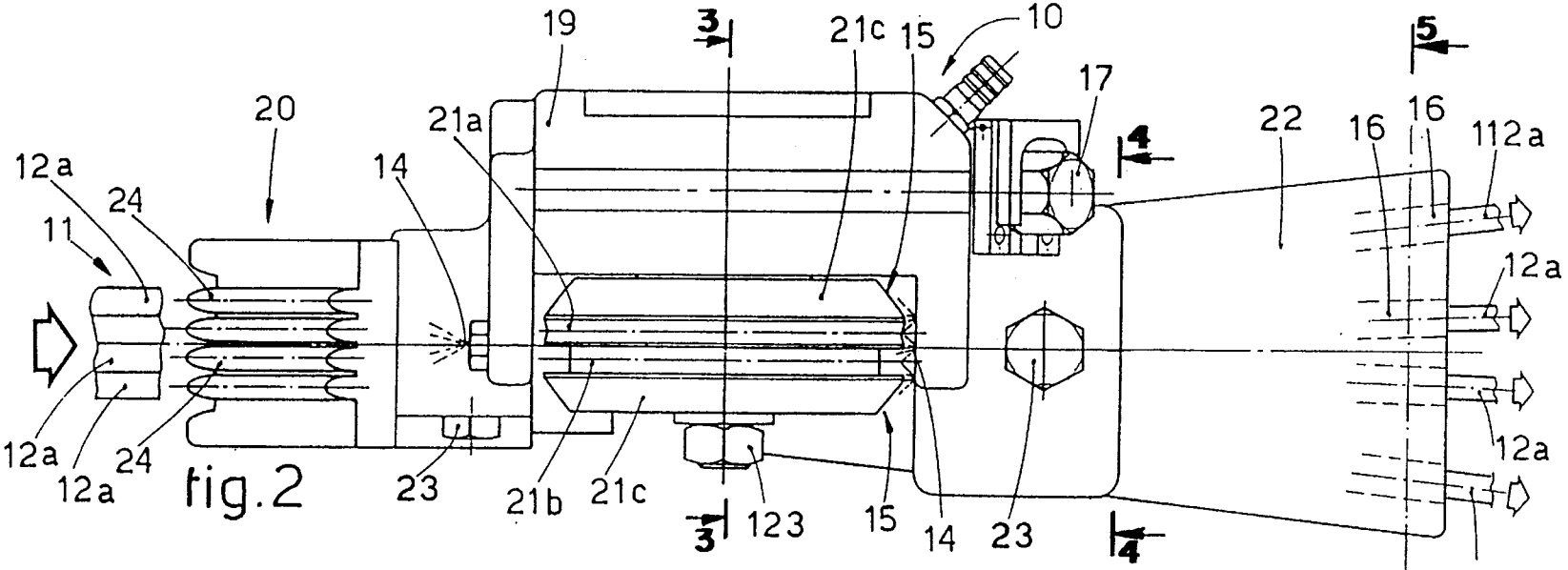
FIG. 2 is a plan view of the box to split the rolled stock of FIG. 1.

In this case (FIGS. 1 and 2) the box 19 comprises sprayer nozzles 14 to spray a cooling fluid so as to cool the rolls 26 of the rolling mill stand 25 located immediately upstream and also the wheels 21–121 of the box 19 that splits the rolled stock according to the invention.

Both the upstream guide 20 and downstream guide 22 can be dismantled by means of respective clamping bolts 23 so as to assist dismantling of the guides 20–22 and to reduce the time required for ordinary maintenance and for any freeing of the single round bars 12*a*–112*a* in the intermediate state.

The box 19 to split rolled stock according to the invention may include a system for adjustment of the distance between centers of the wheels 21–121 of the type disclosed in EP-A-0199402.

This adjustment system includes an adjustment screw 17 which cooperates at a tangent to two eccentric sleeves (not shown here) comprising an external circumferential toothing which mates with the screw thread of the adjustment screw 17. These eccentric sleeves bear the shaft of the wheels 21–121.

We claim:

1. A method to obtain single round bars in a hot state from a multiple element being processed through a rolling line, said multiple element comprising at least four single bars united lengthwise along at least one of their edges, comprising:

rolling said multiple element along a rolling axis on a rolling plane in said rolling line;

separating at least those bars at a central part of said multiple element by contrary vertical displacement of a plane of positioning of one bar in relation to a plane of positioning of an adjacent bar, said planes of positioning remaining substantially parallel to said rolling plane, and, simultaneously, separating outermost lateral bars of said multiple element by sideways displacement on said rolling plane in a direction so as to orient said outermost lateral bars away from the rolling axis of said rolling line; and rolling the separated single bars in at least one finishing stand.

2. Method as in claim 1, whereby the steps of separating the bars forming the multiple element is carried out immediately downstream of a rolling mill stand of said rolling line, and whereby the multiple element is passed through an upstream guiding system and then through two idler wheels of a box that splits the multiple element into single bars, the idler wheels having a central part containing mating passes positioned alternately above and below the rolling plane, and lateral portions containing at least one wedge-shaped bevel by which at least one outermost lateral bar is displaced sideways, the passes and bevel separating the bars from the multiple element, the single bars being guided and steered by a downstream guide containing guide channels.

3. Method as in claim 1, whereby the single bars pass directly to a downstream finishing stand.

4. Method as in claim 1, wherein each of the single bars of which the multiple element is comprised has a round cross-section.

5. Method as in claim 4, wherein the separated single bars are first rolled to have an oval cross-section, then rotated 90° about their axes and rolled to have a round cross-section.

6. Device to obtain in the hot state single finished round bars from a hot multiple element, said multiple element comprising at least four single bars united lengthwise along at least one of their edges, which cooperates with an upstream finishing stand and cooperates directly with rolls of said upstream finishing stand and with generating profiles included in said upstream finishing stand, comprising:

means to displace vertically and reciprocally a plane of positioning of each single bar forming a central part of the multiple element, and, simultaneously to displace sideways on a rolling plane at least the single outermost lateral bars of the multiple element; and upstream guiding system means and mating wheel means which define separation passes and contain at least one lateral edge with a lateral wedge-shaped bevel.

7. Device as in claim 6, in which the means for displacing the single bars consist of a box that splits the multiple element.

8. Device as in claim 6, which comprises a downstream guide with diverging guide channels, which cooperate with the single bars so as to deliver the single bars suitably separated and lying substantially on the rolling plane.

9. Device as in claim 8, in which the downstream guide is detachably connected to the device.

10. Device as in claim 6 in which wheels of the mating wheel means are fitted as cantilevers.

11. Device as in claim 10, which comprises adjustment screw means to adjust a distance between centers of the wheels.

12. Device as in claim 10, which comprises sprayer nozzles cooperating at least with the wheels.

13. Device as in claim 6, in which the upstream guiding system means is detachably connected to the device.

* * * * *